United States Patent [19]

Nishiura et al.

[11] 4,129,307

[45] Dec. 12, 1978

[54] SEALING DEVICE FOR COKE OVEN DOORS

[76] Inventors: Taiji Nishiura, 2-35-1-1017, Minamirokugou, Ohta-ku, Tokyo-to; Kazutomi Shimamura, 2-11-17, Sakuramoto, Kawasaki-ku, Kawasaki-shi, Kanagawa-ken, both of Japan

[21] Appl. No.: 823,201

[22] Filed: Aug. 9, 1977

[30] Foreign Application Priority Data

| | | | |
|---|---|---|---|
| Aug. 23, 1976 | [JP] | Japan | 51-11260[U] |
| Jan. 27, 1977 | [JP] | Japan | 52-8742[U] |
| Feb. 4, 1977 | [JP] | Japan | 52-12768[U] |

[51] Int. Cl.[2] ..... C10B 25/06; F16J 15/46

[52] U.S. Cl. ..... 277/34.3; 277/226; 277/236; 202/248; 49/477; 49/480

[58] Field of Search ..... 202/242, 248, 243, 247; 160/40; 49/480, 481, 477; 277/36, 236, 235 R

[56] References Cited

U.S. PATENT DOCUMENTS

| | | | |
|---|---|---|---|
| 1,948,017 | 2/1934 | Wuebling | 49/481 X |
| 1,973,210 | 9/1934 | Hufnail et al. | 49/481 |
| 2,694,239 | 11/1954 | Brunker | 49/481 |
| 2,778,783 | 1/1957 | Otto | 202/248 X |
| 2,778,785 | 1/1957 | Otto | 202/248 |
| 2,843,375 | 7/1958 | Lesage | 49/481 X |
| 4,002,537 | 1/1977 | Calderon | 202/248 |
| 4,016,045 | 4/1977 | Van Ackeren | 202/248 X |

FOREIGN PATENT DOCUMENTS

| | | | |
|---|---|---|---|
| 834689 | 3/1952 | Fed. Rep. of Germany | 202/248 |
| 611694 | 7/1926 | France | 49/480 |
| 812312 | 2/1937 | France | 202/248 |
| 1098518 | 3/1955 | France | 202/248 |
| 1580 of | 1914 | United Kingdom | 202/248 |

*Primary Examiner*—Robert S. Ward, Jr.
*Attorney, Agent, or Firm*—Holman & Stern

[57] ABSTRACT

A device for sealing a steel door of a coke oven, the structure provides a sealing member disposed over the entire periphery of the steel door, the member closing the opening formed in the wall of the body of the coke oven. The sealing member includes a tubular covering material and a spring disposed within the covering material, the combination forming an elastic member, a metallic seal piece having a seal lip being secured to an end of the elastic member which confronts the coke oven body.

2 Claims, 13 Drawing Figures

SEALING DEVICE FOR COKE OVEN DOORS

BACKGROUND OF THE INVENTION

1. Field of the Invention

The invention generally relates to sealing devices for coke oven doors and, more particularly to a sealing device which retains sealing properties during heat-induced distortion of such doors.

2. Description of the Prior Art

A particular problem encountered in the operation of coke ovens relates to leakage of gases and dust from the coke oven due to inefficient sealing between the steel doors of the oven and the side walls of the oven defining openings into the oven. Sudo, in U.S. Pat. Nos. 3,952,454 and 3,977,125, discloses devices for sealing steel doors of coke ovens, which devices include ring-shaped steel packings and ring-shaped elastic packing assemblies fitted over the outer surfaces of the door so as to contact side walls of the coke oven when the door is closed. Knife edges are usually provided by prior art sealing mechanisms, such mechanisms usually failing to provide a uniform seal about the full periphery of the door especially when distortion of the door and the body of the oven occurs due to the heat of the oven. And devices disclosed in the above U.S. Patents are not sufficient with regard to heat-resistance and contact force to the oven because the packing assemblies have rubber elements and their contact portion to the oven form rather wide surfaces. The present invention provides the full advantages of the prior art, such as the prevention of the escape of internal gases from the coke oven through gaps about the periphery of the door of the oven when the door is closed. The present invention additionally provides a door sealing device whereby the sealing effect is not lost due to heat-induced distortion of the door and oven.

SUMMARY OF THE INVENTION

The present invention provides a device for sealing doors of a coke oven, the present device maintaining adequate sealing properties even on distortion of the coke oven door and the coke oven due to thermally-induced stress within said oven, the present sealing device further being heat resistant and exceptionally durable. According to the invention, a sealing structure is secured about the periphery of the coke oven door, the sealing structure being formed of a covered member having a sealing portion provided with at least one seal lip secured to the outer surface of the covered member. The covered member is further provided with a tubular-sectioned, thin metallic plate, such as could be formed of stainless steel, the plate housing upper and lower U-shaped frames having a spring disposed therebetween. The seal lip is resiliently biased by the spring against the surface of the oven body when the door is closed, thereby preventing gases internally of the oven from leaking between the steel door and the side walls of the oven defining the opening closed by said door. Deformation of the steel door or of the oven body due to thermally-induced stresses is accommodated by the ability of the spring to continuously maintain the seal lip in contact with the surface of the oven body over the entire periphery of the door since the springs continuously bias the seal lip against the surface of the oven body about the full periphery of the seal, a sealing effect being maintained despite normal distortion of the door or oven body.

Accordingly, it is an object of the invention to provide a sealing device, whose most elements are made of metal, for maintaining a sealing effect about a door of a coke oven even though the door or oven body becomes distorted due to the heat of the oven.

It is another object of the invention to provide a device for sealing doors of a coke oven whereby leakage of gases and dust from the coke oven chamber into the surrounding atmosphere is prevented, an elastic sealing member of the present device being continuously biased against the surface of the oven body about the full periphery of the door.

Further objects and advantages of the invention will become more readily apparent in light of the following detailed description of the preferred embodiment.

Figure 8:
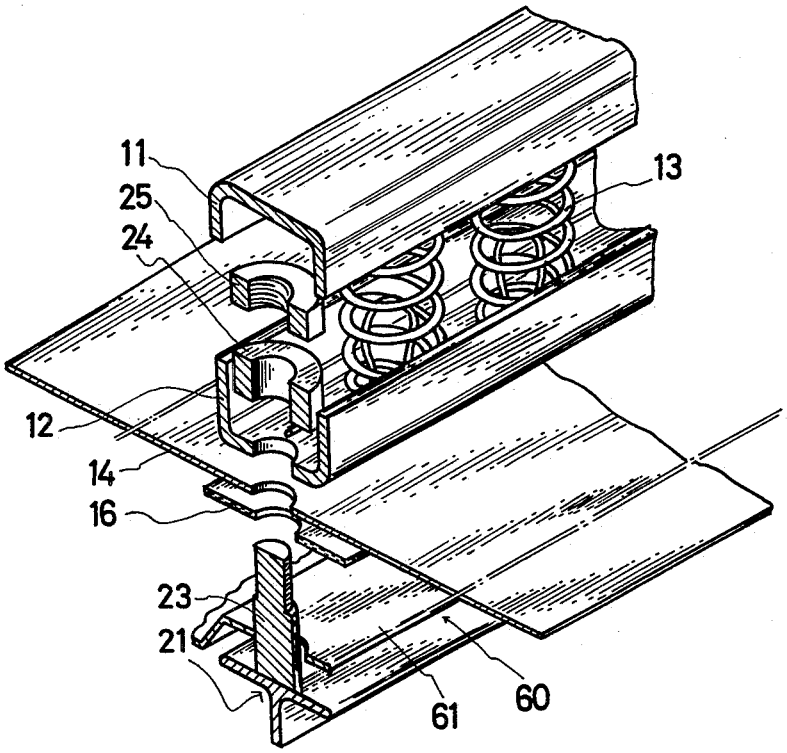
Figure 9:
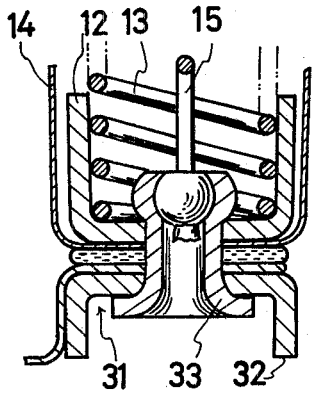
Figure 10:
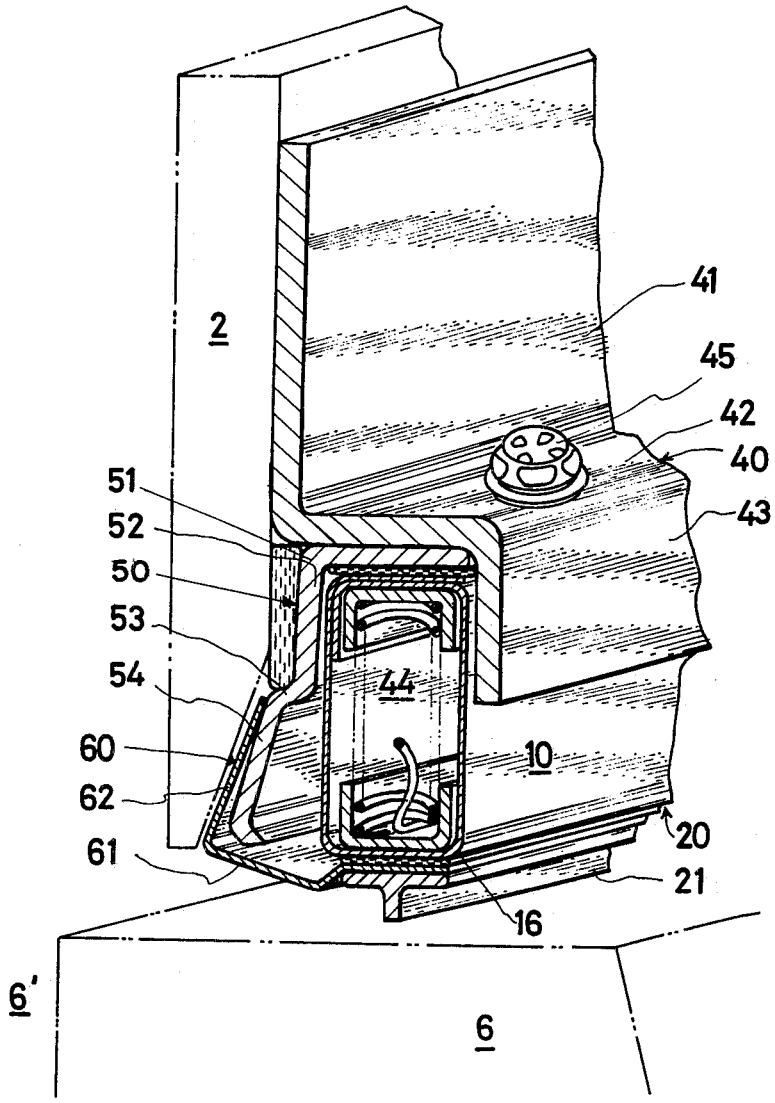
Figure 11:
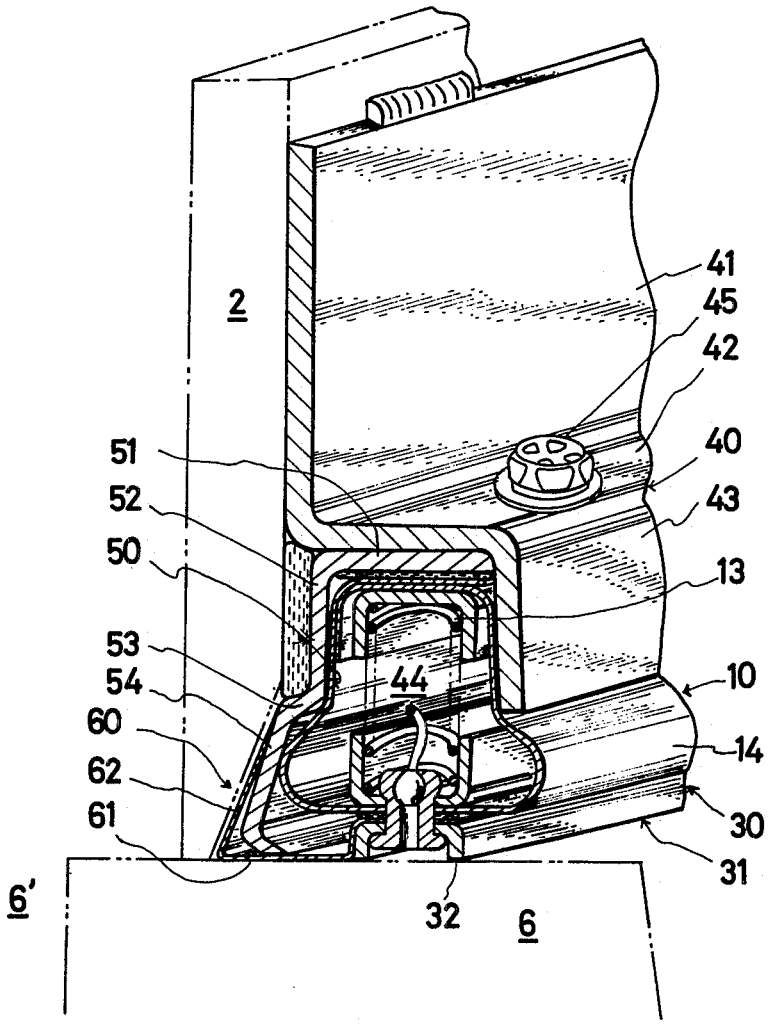
Figure 12:
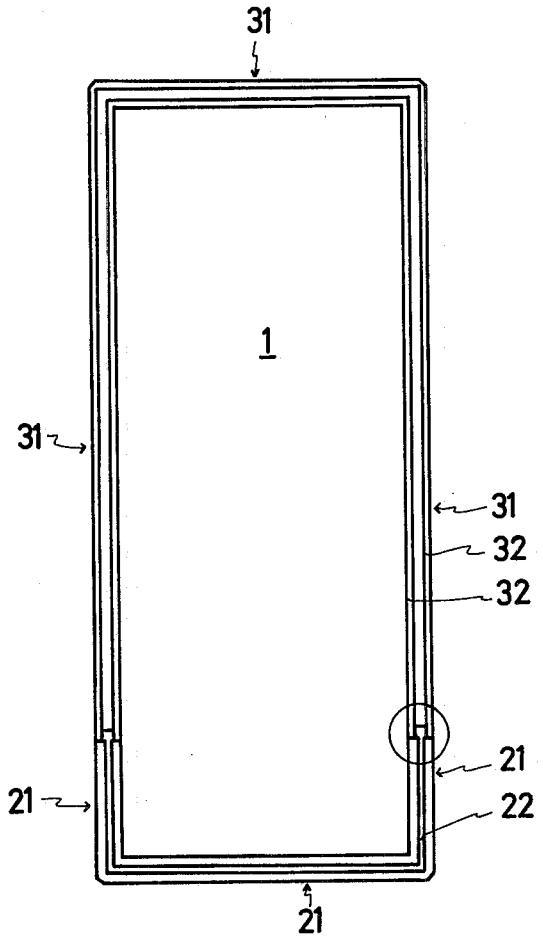
Figure 13:
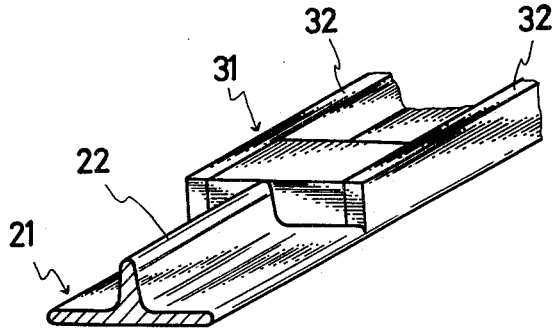

FIGS. *7a*, *7b* and *7c* are partial sectional views of further embodiments of the single-lip sealing members;

FIG. 8 is an assembly view of the present single-lip sealing member;

FIG. 9 is a partial sectional view illustrating the internal structure of the multi-lip sealing member;

FIG. 10 is an oblique sectional view illustrating a door of a coke oven in the open position, a single-lip sealing member of the invention being provided on said door;

FIG. 11 is an oblique sectional view of a coke oven door in the closed position, the door being provided with a multi-lip sealing member according to the invention;

FIG. 12 is an elevational view of a coke oven door provided at its bottom edge and at a portion of its side edge with a single-lip sealing member according to the invention, the door being further provided at its upper edge and at other portions of the side edge thereof with a multi-lip sealing member; and FIG. 13 is a perspective view of a detailed portion of FIG. 12 illustrating the junction between the multi-lip and the single-lip sealing members.

DESCRIPTION OF THE PREFERRED EMBODIMENTS

Figure 1:
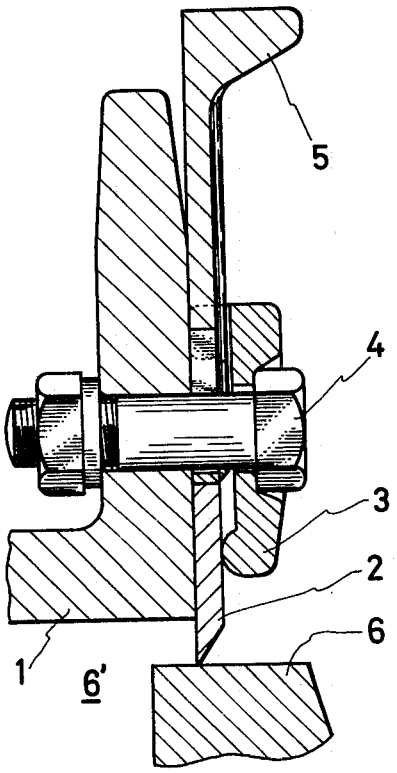
Fig. 1 (prior art)
FIG. 1 is an elevational view in section of a prior art sealing device for coke oven doors.
Figure 2:
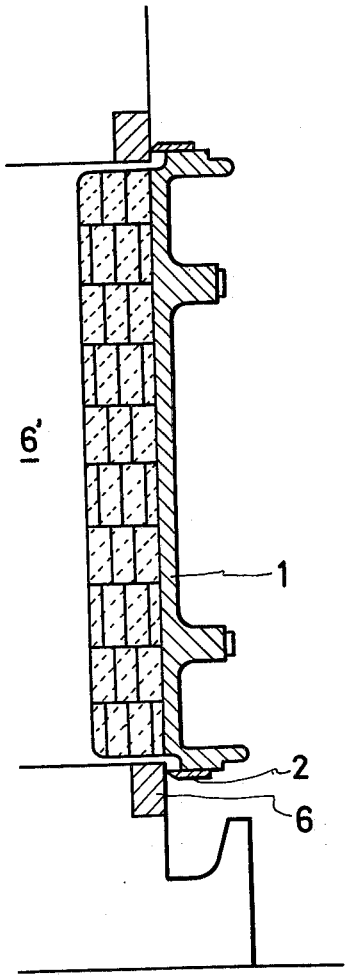
Fig. 2 (prior art)
FIG. 2 is an elevational view in section of a coke oven door provided with the prior art sealing device of FIG. 1.

Referring now to the prior art sealing device of FIGS. 1 and 2, the prior art sealing device is seen to comprise a knife edge 2 disposed at one side of a coke oven door 1, the knife edge 2 being secured to said door by means of a clamping member 3 and bolts 4. A striking tool 5 is adapted to be struck on an enlarged end portion thereof in order to bring the distal edge portion of the knife edge 2 into close engagement with opposing surface portions of an oven body 6. This device fails to provide a uniform sealing effect about the full periphery of the door, especially when the door and/or oven body are caused to be distorted due to the heat of the oven. When such heat-induced distortion occurs, the knife edge 2 becomes separated from the surface of the oven body 6, gaps between the sealing device and the oven body thus forming to allow escape of gases and dust.

Figure 3:
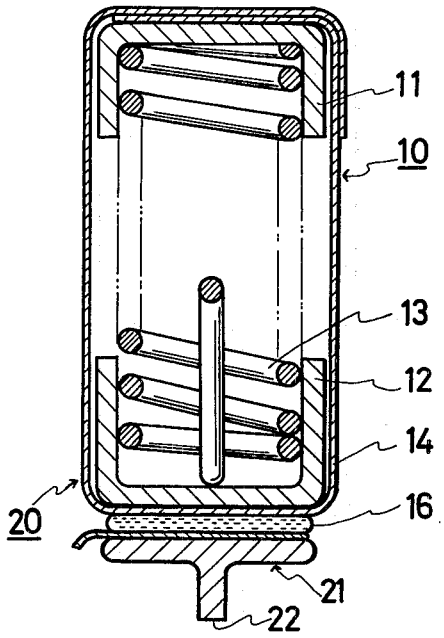
FIG. 3 is a longitudinal sectional view of a single-lip sealing member according to the present invention.
Figure 4:
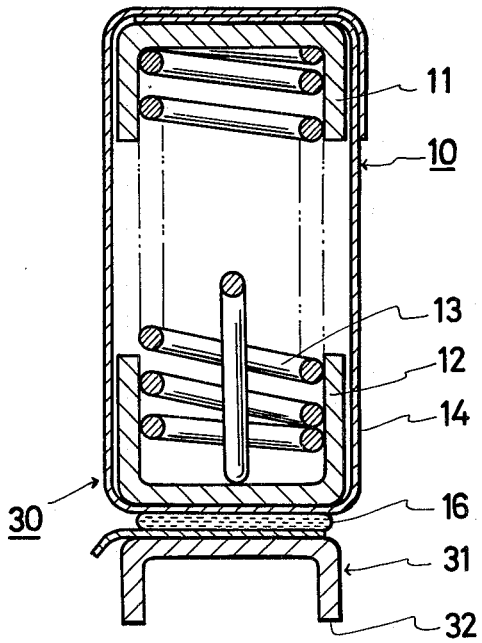
FIG. 4 is a longitudinal sectional view of a multi-lip sealing member according to the invention.

FIGS. 3 and 4 respectively illustrate a single-lip sealing member 20 and a multi-lip sealing member 30, the member 20 being comprised of a single lip sealing element 21 having a single seal lip 22 formed thereon. The multi-lip sealing member 30 comprises a multi-lip sealing element 31 having multiple seal lips 32 formed thereon. The seal lip 22 and the seal lips 32 sealably engage surface portions of the oven body 6 when the door 1 is closed as will be described hereinafter. The sealing members 20 and 30 comprise elastic members 10 which house springs 13, the springs 13 biasing portions of the elastic members 10 into engagement with opposing surfaces of the oven body 6. The sealing members 20 and 30 and the associated sealing elements 21 and 31 are suitably secured to the periphery of the door 1. The elastic members 10 have U-shaped upper and lower frames 11 and 12 disposed therewithin, the frames 11 and 12 being spaced apart and confronting each other, the springs 13 being disposed between said frames and being held in tension therebetween. The frames 11 and 12 are covered by a covering member 14 which can be formed of a suitably thin yet durable material such as stainless steel plate, the covering member 14 being outwardly inflated when a pressure is applied to the elastic member 10 to compress the springs 13.

Figure 5:
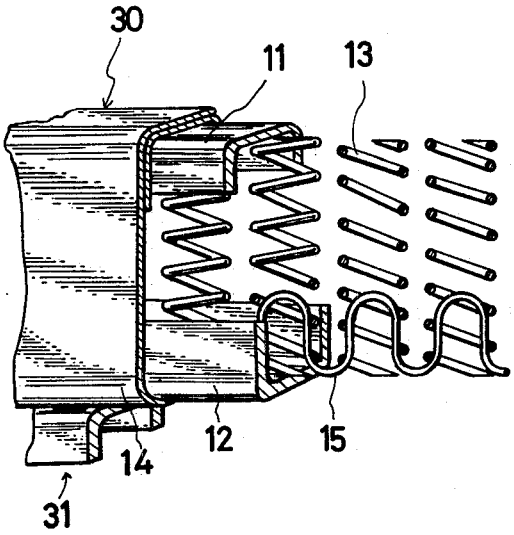
FIG. 5 is an oblique sectional view illustrating the arrangement of spring elements within the sealing members of FIGS. 3 and 4.
Figure 6:
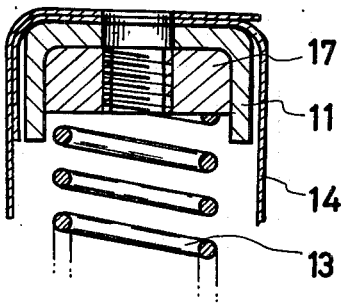
FIG. 6 is a partial sectional view illustrating the attachment of a spring element to the sealing member.

As seen in FIG. 5, the springs 13 are disposed in spaced relation along the length of the sealing members 20 and 30, spacers 15 maintaining the springs 13 at intervals therealong. As shown in FIG. 6, screws 17 are secured into the upper frame 11 at suitable intervals. The sealing element 21 of the single-lip sealing member 20 shown in FIG. 3 is secured to the outer end surface of the elastic member 10 through a strip of asbestos tape 16 as will be described further hereinafter. Similarly, the multi-lip sealing member 30 of FIG. 4 is provided with a connection between the multi-lip sealing element 31 and the outer end surface of the elastic member 10 through a strip of asbestos tape 16.

Figure 7A:
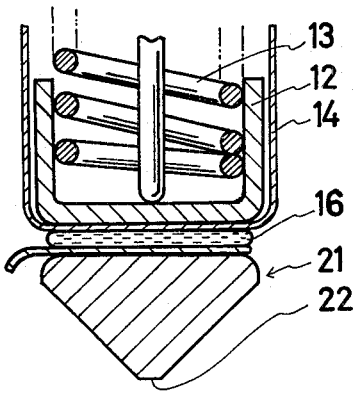
Figure 7B:
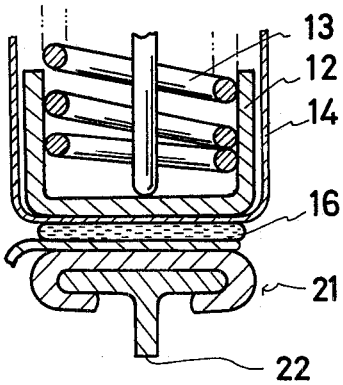
Figure 7C:
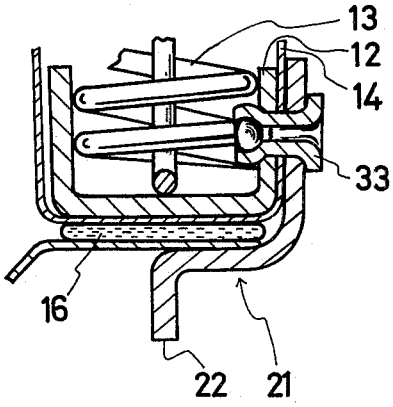

The single-lip sealing element of the sealing member 20 can be formed other than as shown in FIG. 3. For example, the sealing element 21 can be formed with a triangular section as shown in FIG. 7*a*. Alternatively the element 21 can be formed to cooperate with a C-shaped retainer embracing a T-shaped lip as shown in FIG. 7*b*. A combination of a lip and an L-sectioned attaching portion can be used effectively as shown in FIG. 7*c*.

The multi-lip sealing element of the sealing member 30 may be formed as an inverted U as shown in FIG. 4, this form of the element 31 being preferred. FIGS. 8 and 10 illustrate a preferred attachment of the single-lip sealing element 21 to the elastic member 10. A bolt 23 is previously welded to the single-lip sealing element 21. The element 21 is then brought into abutment with the end surface of the lower frame 12, clamping therebetween a bottom plate 61 of a thin metallic tar-receiving cover 60. The bolt 23 is fastened by a nut 25 through a ring 24. The tar-receiving cover 60 has an L-shaped section formed by the bottom plate 61 and side plate 62 formed by bending the end of the bottom plate 61 at an acute angle. The strip of asbestos tape 16 is also clamped between the covering member 14 and the sealing element 21. The sealing elements 21 and 31 can also be secured to the elastic members 10 by means of rivets 33 such as are shown in FIGS. 7*c* and 9.

As seen in FIG. 10, a metallic front cover 40 has an attachment plate 41, a top plate 42 extending from the end of the attachment plate 41 at right angles thereto, the front cover 40 further having a front skirt 43 formed by bending the end of the top plate 42 at a right angle. A metallic rear cover 50 has a middle plate 51, a rear skirt 52 forming a right angle to the middle plate 51 at the end thereof, a step 53 being provided at the end of the rear skirt 52 and a skirt section 54 extending obliquely from the step 53. The front and rear covers 40 and 50 are assembled in such a manner that the top and middle plates 42 and 51 are superimposed. The sealing members 20 or 30 are inserted into a groove 44 formed between the front and rear skirts 43 and 52. Attaching bores formed in the top and middle plates 42 and 51 are thus brought into alignment with the screws 17 as is also shown in FIG. 6, such that the sealing members 20 or 30 can be secured to the front and rear covers 40 and 50 by means of bolts 45, thereby allowing the side plate 62 of the tar-receiving cover 60 to cover the skirt section 54 of the rear cover 50. The end of the side plate 62 is secured to the skirt section 54 in the vicinity of the step 53 by suitable means such as spot welding. The attachment plate 41 of the front cover 40 is attached to the peripheral side of the door 1, generally through knife edge 2, such as by welding or by means of structure such as the elements 3 and 4 of FIG. 1, whereby the sealing members 20 or 30 are secured to the door 1. The apparatus of FIG. 10 illustrates a door in the open position, a single-lip sealing member 20 being provided to seal opening 6' defined by the oven body 6. The springs 13 and the covering member 14 in FIG. 10 are shown in a stretched conformation, the tar-receiving cover being also slightly stretched.

FIG. 11 illustrates a multi-lip sealing member 30 in a fully sealed position contiguous to the oven body 6. The springs 13 are seen to be compressed, the covering member 14 being inflated in order to allow deformation of the tar-receiving cover 60. In this conformation, the seal lips 32 are pressed into the surface of the oven body 6 by the elastic force exerted by the springs 13, gaseous materials within the oven being thereby prevented from leaking out of the oven. Although the multi-lip sealing member 30 is relatively easier to manufacture than the single-lip sealing member 20 and is further superior in sealing function, the member 30 can at times allow tar leaking through the gap at the bottom portion of the door 1 to be caught between the parallel lips 32, thereby causing some deterioration of the sealing effect. Accordingly, it is further proposed to use the sealing members 20 and 30 in combination, the single-lip sealing member 20 being provided at a lower edge and at a portion of a side edge approximate to the lower edge of the door 1, the multi-lip sealing member being provided at the upper edge and at portions of the side edge where the single-lip sealing member 20 is not provided. As seen in FIG. 13, the sealing members 20 and 30 can be suitably connected to each other without discontinuity. The sealing members 20 and 30 may therefore be arranged as shown in FIG. 12 to provide increased sealing effect about the door 1.

It is to be understood that the invention may be practiced other than as specifically described hereinabove, the scope of the invention be limited only by the definition provided by the appended claims.

What is claimed is:

1. A device for sealing a steel door of a coke oven comprising elastic sealing means disposed on the door and including at least one spring member and an elastic covering tubular member of thin metal being outwardly inflated when a pressure is applied to said elastic sealing means to compress said spring member, said spring member covered by said covering tubular member and disposed to bias the covering member to extend the length thereof in one direction; and a sealing element having a seal lip, the sealing element being secured to the sealing means in confronting relation to the body of the coke oven, the seal lip engaging surface portions of said coke oven body on closure of the door and being resiliently biased thereagainst by the elastic sealing means.

2. The device of claim 1 wherein the sealing element is provided at lower and side portions of the door proximate to the lower portions with a single seal lip and is provided at other portions thereof with a plurality of seal lips.

* * * * *